US007011159B2

(12) United States Patent
Holland

(10) Patent No.: US 7,011,159 B2
(45) Date of Patent: Mar. 14, 2006

(54) COMPACT MID-GRIP FASTENER

(75) Inventor: William R. Holland, Houston, TX (US)

(73) Assignee: Hydril Company, L.P., Houston, TX (US)

( * ) Notice: Subject to any disclaimer, the term of this patent is extended or adjusted under 35 U.S.C. 154(b) by 154 days.

(21) Appl. No.: 10/663,287

(22) Filed: Sep. 16, 2003

(65) Prior Publication Data

US 2005/0056432 A1 Mar. 17, 2005

(51) Int. Cl.
*E21B 33/038* (2006.01)

(52) U.S. Cl. ..... 166/360; 166/241.7; 166/378

(58) Field of Classification Search ..... 166/241.7, 166/351, 360, 363, 365, 378
See application file for complete search history.

(56) References Cited

U.S. PATENT DOCUMENTS

| | | | | |
|---|---|---|---|---|
| 4,580,628 | A * | 4/1986 | Schaeper | 166/85.4 |
| 4,646,825 | A * | 3/1987 | Van Winkle | 166/55 |
| 4,696,611 | A | 9/1987 | Guay | 411/103 |
| 4,786,201 | A | 11/1988 | Huetter et al. | 403/22 |
| 4,928,531 | A | 5/1990 | Schult et al. | 73/855 |
| 5,681,189 | A | 10/1997 | Dunham | 439/738 |
| 6,408,947 | B1 | 6/2002 | Cunningham et al. | 166/339 |
| 2002/0025241 | A1 | 2/2002 | Mizuno et al. | 411/378 |
| 2002/0150444 | A1 | 10/2002 | Mhaimeed | 411/383 |

FOREIGN PATENT DOCUMENTS

| | | |
|---|---|---|
| DE | G 89 10 965.1 | 11/1990 |
| DE | G 94 05 413.4 | 7/1994 |
| DE | 0 824 173 A1 | 2/1998 |
| DE | 197 15 496 C 1 | 6/1998 |
| DE | 201 08 026 U 1 | 9/2001 |
| DE | 101 62 910 A 1 | 11/2002 |
| EP | 0 124 054 A 1 | 11/1984 |
| EP | 0 523 393 A1 | 1/1993 |
| EP | 0 523 393 B1 | 4/1994 |
| EP | 1 184 582 A2 | 3/2002 |
| EP | 1 184 582 A3 | 3/2002 |
| GB | 1382 236 | 1/1975 |
| GB | 1 558 022 | 12/1979 |
| GB | 2 240 831 A | 8/1991 |
| GB | 2 364 109 A | 1/2002 |

OTHER PUBLICATIONS

International Search Report and Written Opinion for Appl No. PCT/US04/30223; Dated Oct. 24, 2005; 8 pages.

* cited by examiner

*Primary Examiner*—Zakiya Walker
(74) *Attorney, Agent, or Firm*—Osha Liang LLP

(57) ABSTRACT

A fastener for coupling blowout preventers in a stack including an elongated shaft having a first end and a second end, and a head disposed proximate the first end of the elongated shaft and adapted to be retained in a recess in a first blowout preventer. The second end of the elongated shaft is adapted to be coupled to a second blowout preventer.

30 Claims, 10 Drawing Sheets

COMPACT MID-GRIP FASTENER

BACKGROUND OF INVENTION

Well control is an important aspect of oil and gas exploration. When drilling a well in, for example, oil and gas exploration applications, devices must be put in place to prevent injury to personnel and equipment associated with drilling activities. One such well control device is known as a blowout preventer (BOP).

BOPs are generally used to seal a wellbore. For example, drilling wells in oil or gas exploration involves penetrating a variety of subsurface geologic structures, or "layers." Generally, each layer is of a specific geologic composition such as, for example, shale, sandstone, limestone, etc. Each layer may contain trapped fluids or gas at different formation pressures, and the formation pressures generally increase with increasing depth. The pressure in the wellbore is typically adjusted to at least balance the formation pressure by, for example, increasing the density of drilling mud in the wellbore or increasing the pump pressure at the surface of the well.

There are occasions during drilling operations when a wellbore may penetrate a layer having a formation pressure that is substantially higher than the pressure maintained in the wellbore. When this occurs, the well is said to have "taken a kick." The pressure increase associated with this "kick" is generally produced by an influx of formation fluids (which may be a liquid, a gas, or a combination of liquid and gas) into the wellbore. The relatively high pressure "kick" tends to propagate from a point of entry in the wellbore uphole (from a high pressure region to a low pressure region). If the "kick" is allowed to reach the surface, drilling fluid, well tools, and other drilling structures may be blown out of the wellbore. These blowouts often result in catastrophic destruction of the drilling equipment (including, for example, the drilling rig) and a substantial risk of injury or death to rig personnel.

Because of the risks associated with blowouts, BOPs are typically installed at the surface or on the sea floor in deep water drilling arrangements so that "kicks" may be adequately controlled and circulated out of the system. BOPs may be activated to effectively seal a wellbore until active measures can be taken to control the kick.

Because of the extreme pressure that can be released during a kick, it is common practice to operate a "stack" of BOPs, where several BOPs are connected in a vertical relationship. For example, FIG. 1 shows a BOP stack 100 with an upper BOP 104 stacked on top of a lower BOP 102. Typically, the bottom end of the lower BOP 102 is coupled to the well head (not shown), and the top end of the upper BOP 104 is coupled to drilling or production equipment (not shown). It is also common to include more than two BOPs in an BOP stack.

Each BOP 102, 104 typically includes a center passage (shown in dashed lines) that passes vertically through the BOPs 102, 104. It is these passages that well tools pass through during drilling and that the crude oil and gas passes through during production. It will be understood that each BOP 102, 104 may include rams, blocks, bonnets, and other BOP equipment that are not shown in FIG. 1. FIG. 1 is intended only to show the relative positions of BOPs in a BOP stack.

The BOPs 102, 104 are coupled together at the upper end of the lower BOP 102 and the lower end of the upper BOP 104. FIGS. 2A–2C show several prior art methods for coupling two BOPs together.

FIG. 2A shows a side view of a BOP stack 200 with a lower BOP 202 and an upper BOP 204 that are coupled together. The BOPs 202, 204 are coupled in a "flange-to-flange" arrangement. The lower BOP 202 has an upper flange 203, and the upper BOP 204 has a lower flange 205. The flanges 203, 205 are mated against each other so that the internal bores (shown in dashed lines) of each BOP 202, 204 are lined up.

Studs 207 are passed through both the flange 203 on the lower BOP 202 and the flange 205 on the upper BOP 204. A nut 209 is used on each end of each stud 207 to retain the flanges 203, 205 in place and couple the BOPs 202, 204 together. FIG. 2A shows only two studs 207, but a typical BOP stack may use twelve studs arranged in a bolt pattern around the flanges 203, 205. A larger BOP will generally require more studs, and there is no limit to the number used.

FIG. 2B shows a cross section of a BOP stack 210 in a "flange-to-stud" arrangement. The upper BOP 214 includes a lower flange 215 that is mated against a sealing surface 216 on the top of the lower BOP 212. The lower BOP 212 does not include a flange. Studs 217 are fixed in the lower BOP 212 about the center passage (shown in dashed lines), and the studs 217 pass through the flange 215 of the upper BOP 214. Nuts 219 retain the flange 215 on the upper BOP 214 against the sealing surface 216 on the lower BOP 212.

FIG. 2C shows a cross section of a BOP stack 220 that includes two BOPs 222, 224 connected using a "stud-to-stud" arrangement with a spool 231. The spool 231 includes an upper flange 232, a lower flange 233, and a central passage (shown in dashed lines) that is aligned with the central passages of the BOPs 222, 224. Each of the BOPs 222, 224 includes studs 227 that are fixed about the central passage. The spool is aligned with the studs 227 on each BOP 222, 224, and the studs pass through the flanges 232, 233 of the spool 231. Nuts 229 retain the spool in place to connect the BOPs 222, 224.

Each of these connection methods requires the use of at least one flange, which adds to the height of the BOP stack. Because of the limited space near the well head, it is desirable to reduce the BOP stack height as much as possible.

SUMMARY OF INVENTION

In some embodiments, the invention relates to a fastener for coupling blowout preventers in a stack. The fastener includes an elongated shaft having a first and a second end, with a head disposed proximate the first end of the shaft. The head may be adapted to be retained in a recess in a connecting face of a first blowout preventer. The second end of the elongated shaft may be coupled to a second blowout preventer. In some embodiments, the second end of the elongated shaft is in threaded engagement with the second blowout preventer.

In other embodiments, the invention relates to a coupled blowout preventer stack comprising a first blowout preventer having a plurality of recesses in a connecting face and a second blowout preventer in a vertical arrangement with the first blowout preventer. The blowout preventer stack also includes a plurality of fasteners each having an elongated shaft with a first end and a second end, the plurality of fasteners each comprising a head proximate the first end of the elongated shaft. The heads are disposed in the plurality of recesses in the first blowout preventer, and the second ends of the plurality of fasteners are coupled to the second blowout preventer.

In some embodiments, the invention relates to a method for coupling two blowout preventers in a blowout preventer stack. The method includes coupling a first end of a plurality of fasteners to a first blowout preventer and positioning a second blowout in a vertical arrangement with the first blowout preventer so that a head on a second end of each of the plurality of fasteners is received in one of a plurality of recesses in a connecting face of the second blowout preventer. The method may also include coupling a plurality of retaining collars to the second blowout preventer so that the heads of the plurality of fasteners are retained in the plurality of recesses in the second blowout preventer and tightening the connection.

In some embodiments the invention relates to a fastener for coupling blowout preventers in a stack comprising a first member having a first head adapted to be retained in a recess in a first blowout preventer, and a second member adapted to be coupled to a second blowout preventer. The first member and the second member are configured to be coupled to each other.

Other aspects and advantages of the invention will be apparent from the following description and the appended claims.

DETAILED DESCRIPTION

In certain embodiments, the invention relates to a fastener for coupling two blowout preventers ("BOP") together in a BOP stack. In some embodiments, a fastener may include a grip section that enables the fastener to be gripped and rotated. A grip section may be located on the fastener so that the grip section may be accessed in the space between the BOP's. In some other embodiments, a retaining collar on a BOP includes a bolt section that can be gripped and rotated. The invention is referred to as a "mid-grip" fastener because instead of gripping and rotating a bolt or nut behind a flange, a fastener or retaining collar according to the invention may be gripped in the space between the two BOP's. Certain embodiments of the invention will now be described with reference to the attached figures.

Figure 1:
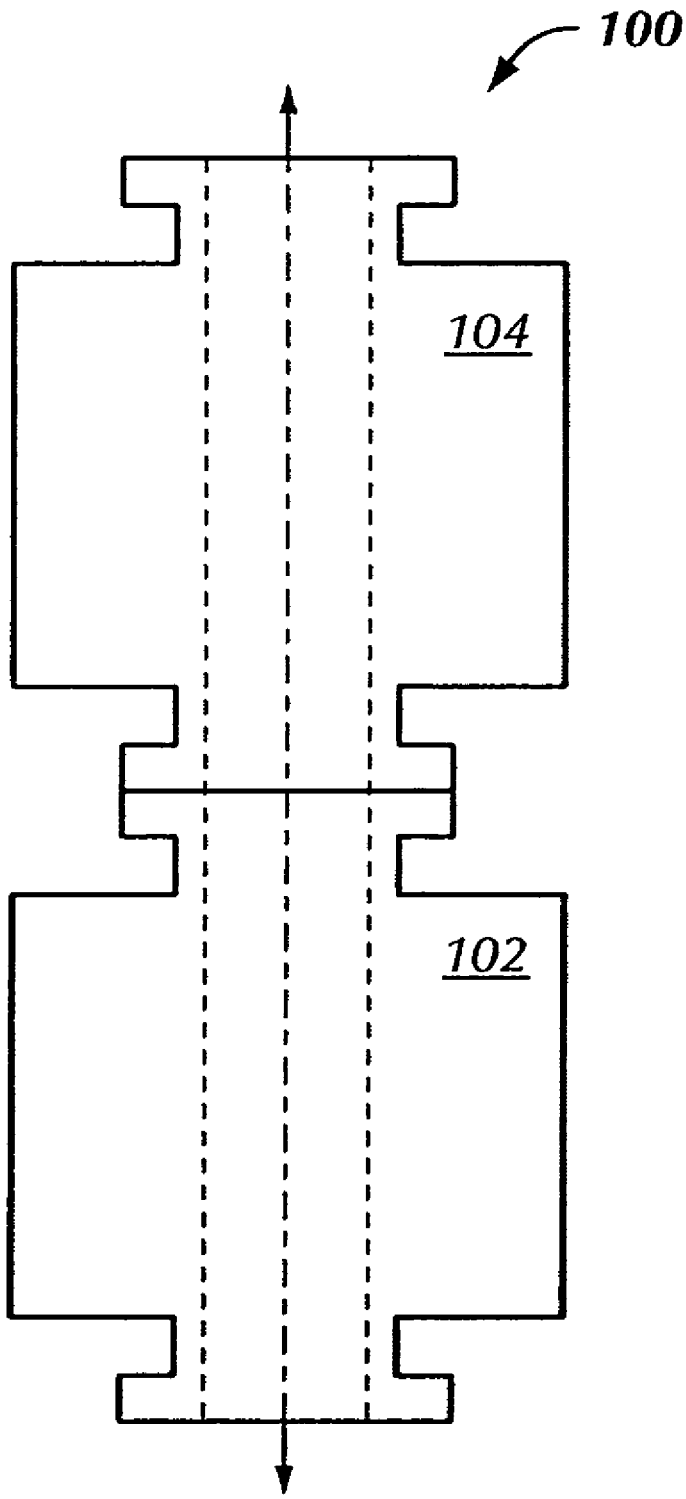
FIG. 1 PRIOR ART
FIG. 1 shows a cross section of a blowout preventer stack.
Figure 2A:
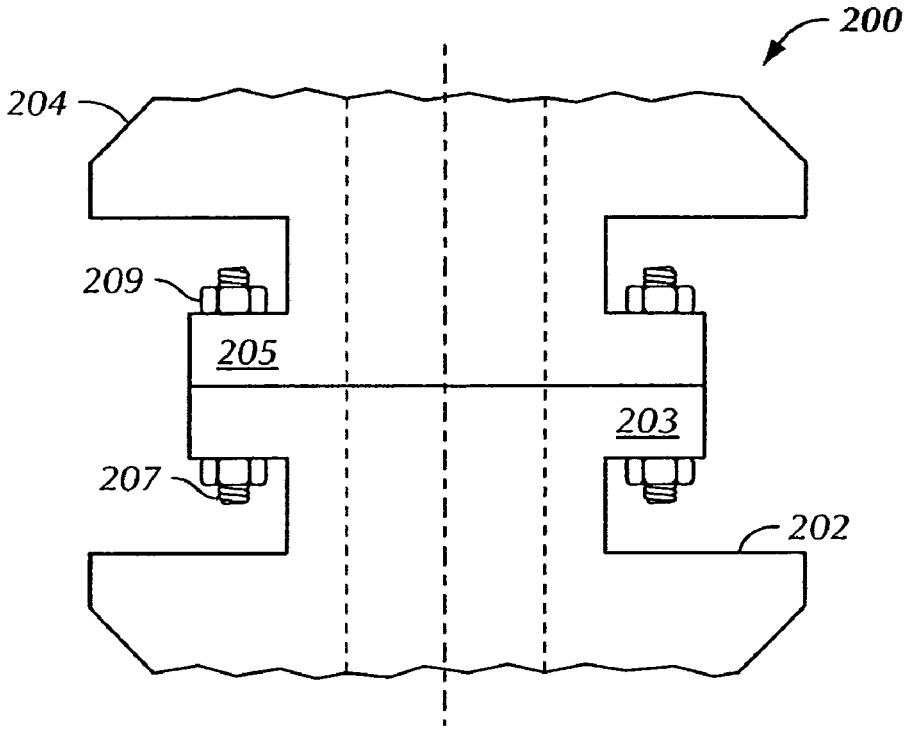
FIG. 2A PRIOR ART
FIG. 2A shows a side view of a prior art flange-to-flange connection.
Figure 2B:
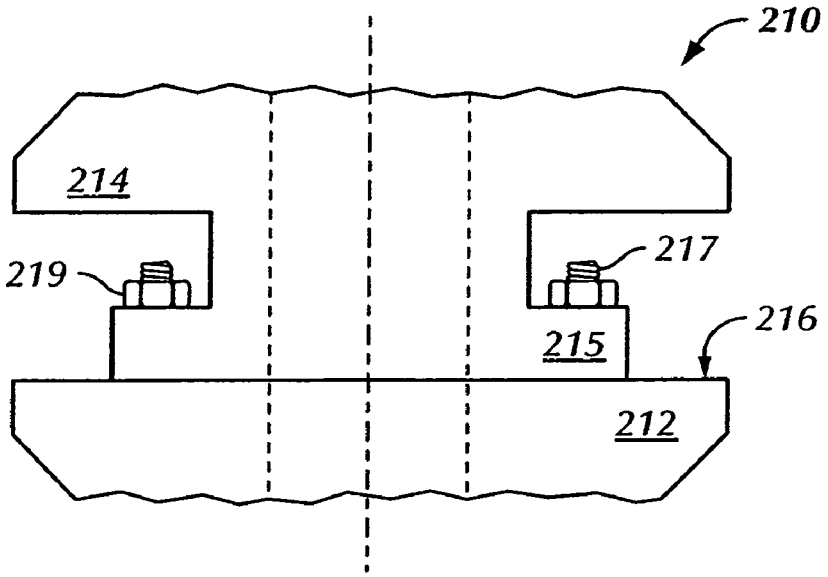
FIG. 2B PRIOR ART
FIG. 2B shows a side view of a prior art flange-to-stud connection.
Figure 2C:
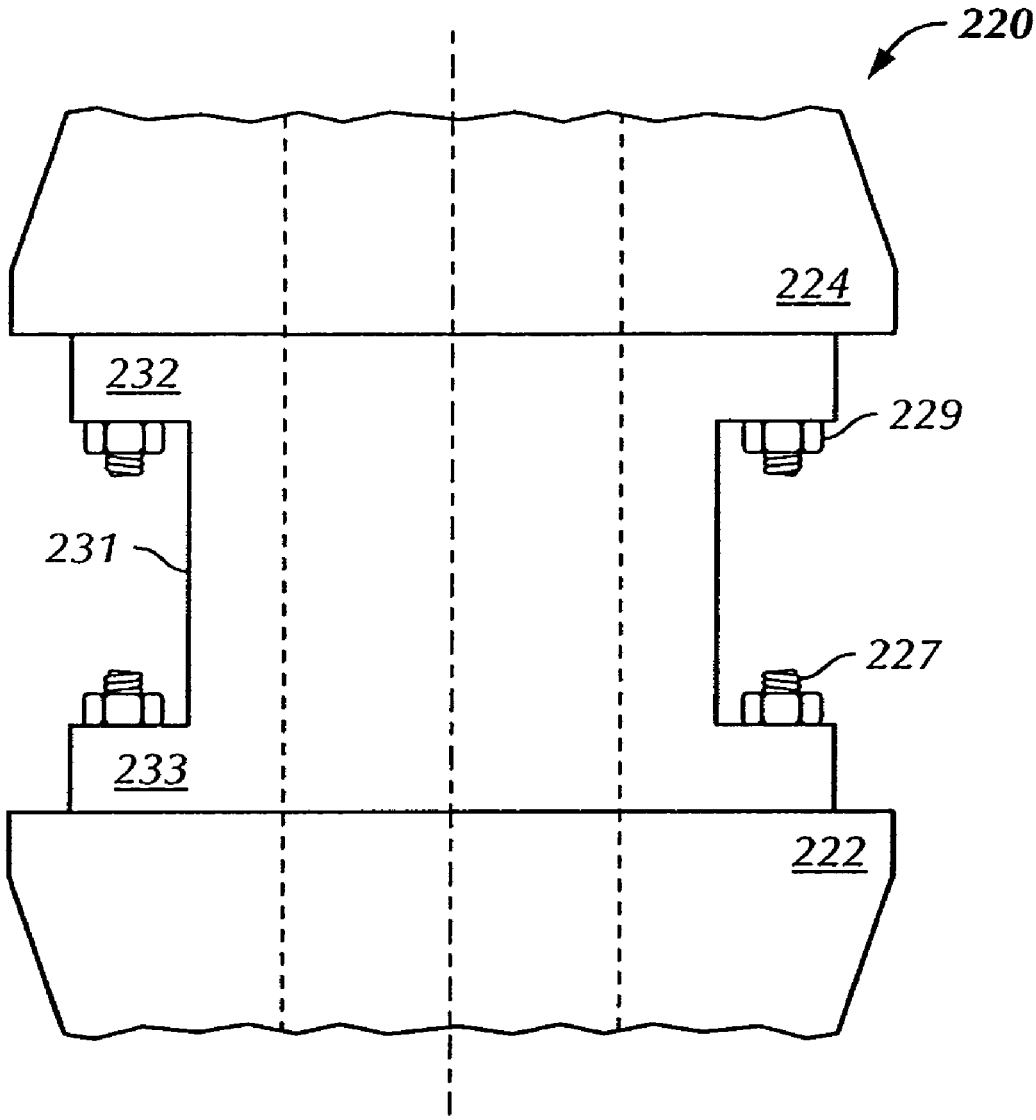
FIG. 2C PRIOR ART
FIG. 2C shows a side view of a prior art stud-to-stud connection with a spool.
Figure 3:
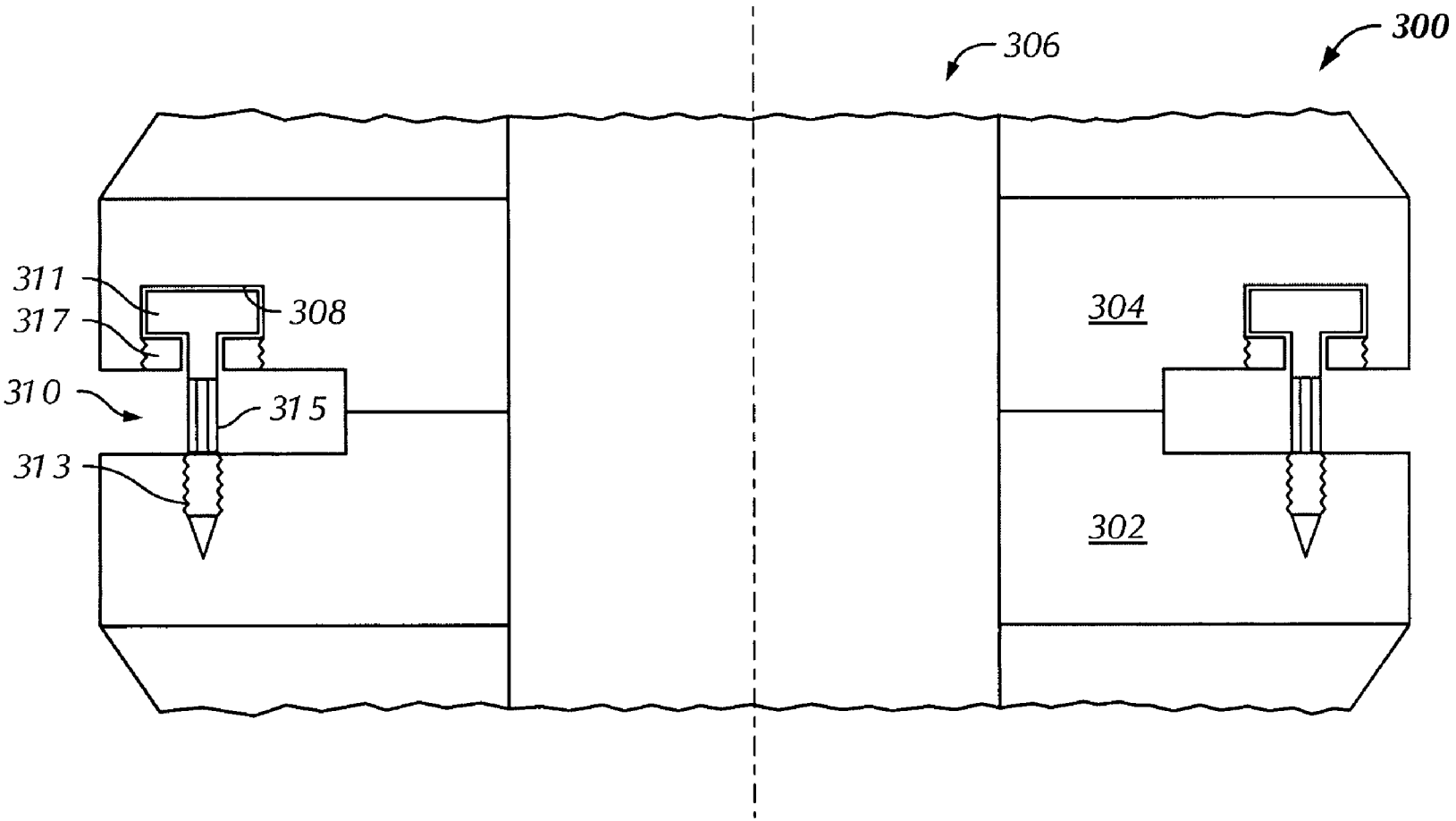
FIG. 3 shoes a cross section of a blowout preventer stack that is connected with one embodiment of a fastener in accordance with the present invention.

FIG. 3 shows a cross section of one embodiment of a fastener in accordance with the invention. A lower BOP 302 and an upper BOP 304 are coupled together in a BOP stack 300. Central passages in each BOP 302, 304 (passages shown generally at 306) are aligned. The BOPs 302, 304 are coupled using multiple fasteners (e.g., the one shown at 310). The cross section of FIG. 3 shows only two fasteners in the "bolt pattern," but, as is known in the art, bolt patterns may include any number of bolts. In this case, the fasteners take the place of the bolts in the bolt pattern.

The fastener 310 includes a head 311 that is disposed inside a recess 308 in the upper BOP 304. The head 311 is retained in the recess 308 by a retaining collar 317 positioned in the recess 308. The opposite end of the fastener 310 includes a threaded section 313 that is in a threaded engagement with the lower BOP 302. The recess 308 is located in the connecting face of the upper BOP 304 that is being coupled to the lower BOP 302. A "connecting" face is the face of the BOP that faces the another BOP to which the first BOP is coupled.

The fastener 310 includes a grip section 315 that may be gripped by a wrench or other tool (not shown) that can apply torque to the fastener 310. As the fastener 310 is rotated in one direction, the threaded section 313 further engages the lower BOP 302, and the head 311 pulls the upper BOP 304 into engagement with the lower BOP 302. The grip section 315 is located on the fastener 310 so that it can be accessed in the space between the BOPs 302, 304.

Figure 4A:
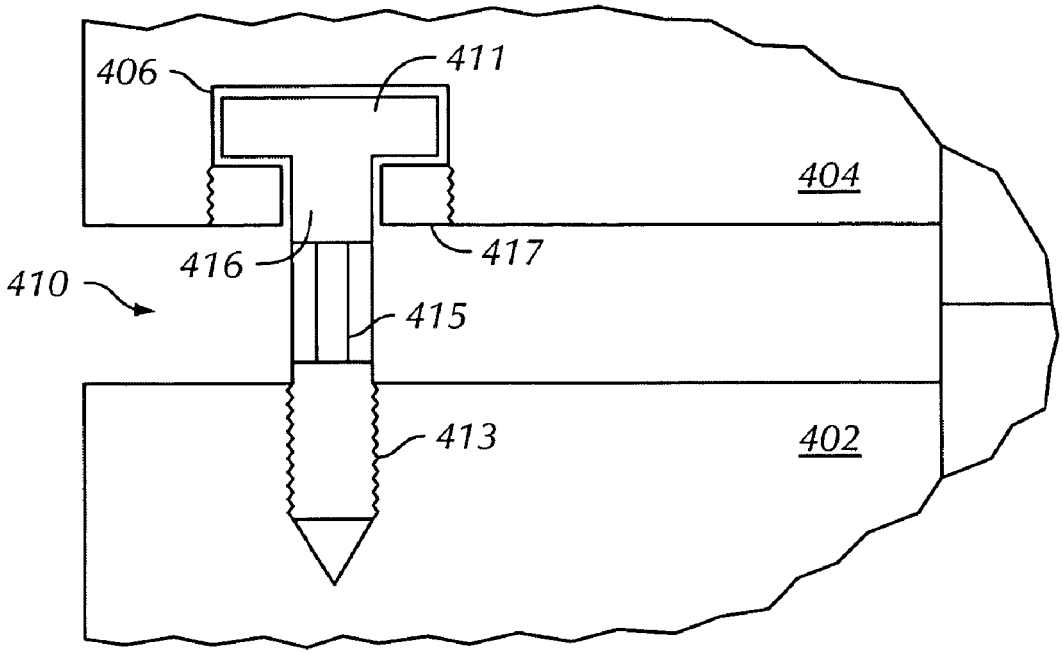
FIG. 4A shows a cross section of a fastener in accordance with one embodiment of the invention.

FIG. 4A shows a close up of a cross section of one embodiment of a fastener 410 in accordance with the invention. A lower BOP 402 and an upper BOP 404 are coupled together in a BOP stack 400 by a fastener 410. The fastener 410 has an elongated shaft 416 with a head 411 at one end and a threaded section 413 at the other end. The head 411 is retained in a recess 406 of the upper BOP 404 and the threaded section 413 that is engaged with the lower BOP 402.

The head 411 of the fastener 410 is retained in the recess 406 of the upper BOP 404 by a retaining collar 417. In the embodiment shown, the head 411 is an integral part of the shaft 416. In other embodiments, the head 411 comprises a separate piece that may be coupled to the shaft 416, for example, by threads, as would be done with a nut. One embodiment of a fastener that includes a nut is described later with reference to FIG. 7B. Those having ordinary skill in the art will be able to devise other methods of coupling a head portion to a fastener without departing from the scope of the invention.

In the embodiment shown, the retaining collar 417 is an annular retaining collar that includes a center passage through which the elongated shaft 416 may pass. The retaining collar 417 also includes a threaded outer section that can be coupled to corresponding threads in the recess 406 of the upper BOP 404. This enables the head 411 to be inserted into the recess 406 and then retained by threading the retaining collar 417 into the recess 406.

In the embodiment shown, the threaded section 413 of the fastener 410 is coupled to the lower BOP 402 by a threaded engagement. It is also within the scope of the invention for a fastener to include two head sections without a threaded section. Certain of these embodiments are described later with reference to FIGS. 7A and 7B.

In the embodiment shown in FIG. 4A, the fastener 410 includes a grip section 415 that enables a wrench or other tool (not shown) to grip the fastener 410 and cause it to rotate. In the embodiment shown, the grip section 415 comprises a hexagonal-shaped surface that enables a wrench to grip the fastener 410. The grip section 415 is located on elongated shaft 416 so that it can be accessed in the space between the BOPs 402, 404. Other shapes and grip types may be used without departing from the scope of the invention. For example, the grip section may comprise a square-shaped surface or an octagonal-shaped surface. Those having ordinary skill in the art will be able to devise other grip sections that do not depart from the scope of the invention. It is also noted that the details of the grip section, while they would not generally appear in this cross section, are shown in the Figures for illustrative purposes.

Once the upper BOP 404 is in position and the retaining collar 417 has been installed to retain the head 411 of the fastener 410 in the recess 406, the fastener 410 may be rotated to "tighten" or "loosen" the engagement between the upper BOP 404 and the lower BOP 402. FIG. 4A shows how a fastener 410 may be used to "tighten" or "loosen" the engagement between two BOPs 402, 404 in a BOP stack. Rotation of the fastener 410 may be in either direction, where one direction will tighten the connection, and the opposite directed will loosen the connection.

"Tighten," as used herein, means to increase the connection force between the two BOPs. This is accomplished by rotating the fastener 410 so that the threaded section 413 will further engage the lower BOP 402. The fastener 410 will be driven further into the lower BOP 402, and the head 411 will be pulled downward. Because the head 411 is retained in the recess 406 by a retaining collar 417, the downward movement of the head 411 will pull the upper BOP 404 toward the lower BOP 402, thereby increasing the forces of the engagement of the BOPs 402, 404.

"Loosen," as used herein, means to decrease the connection force between the two BOPs 402, 404. This is accomplished by rotating the fastener 410 in the other direction, so that engagement of the threaded section 413 causes the fastener 410 to be driven out of the lower BOP 402. This will move the head 411 upwardly and release some of the forces between the BOPs 402, 404.

The threaded engagement between the threaded section 413 of the fastener 410 and the lower BOP 402 is designed to support the forces between two BOP's in a BOP stack. In some embodiments, such as the ones shown in FIG. 4A, the invention includes a threaded engagement because of the strength of this type of connection in supporting compressive and tensile loads, and because a threaded connection enables the connection forces to be controlled and adjusted after an upper BOP is installed in the BOP stack. Other types of connections between a fastener and a BOP may be used without departing from the scope of the invention.

Figure 4B:
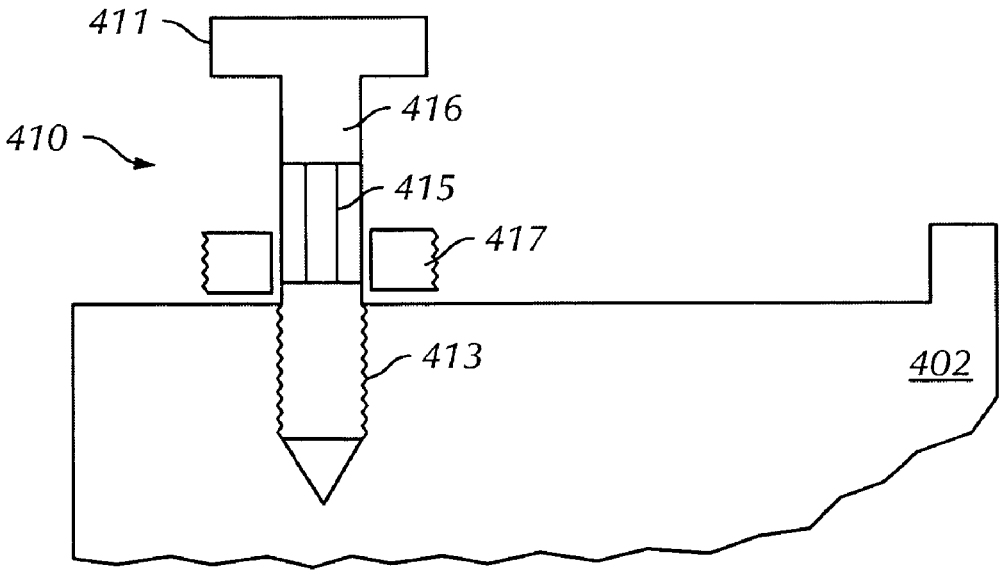
FIG. 4B shows a cross section of one embodiment of a fastener in accordance with the invention coupled to one blowout preventer before a second blowout preventer is vertically arranged with the first blowout preventer.
Figure 4C:
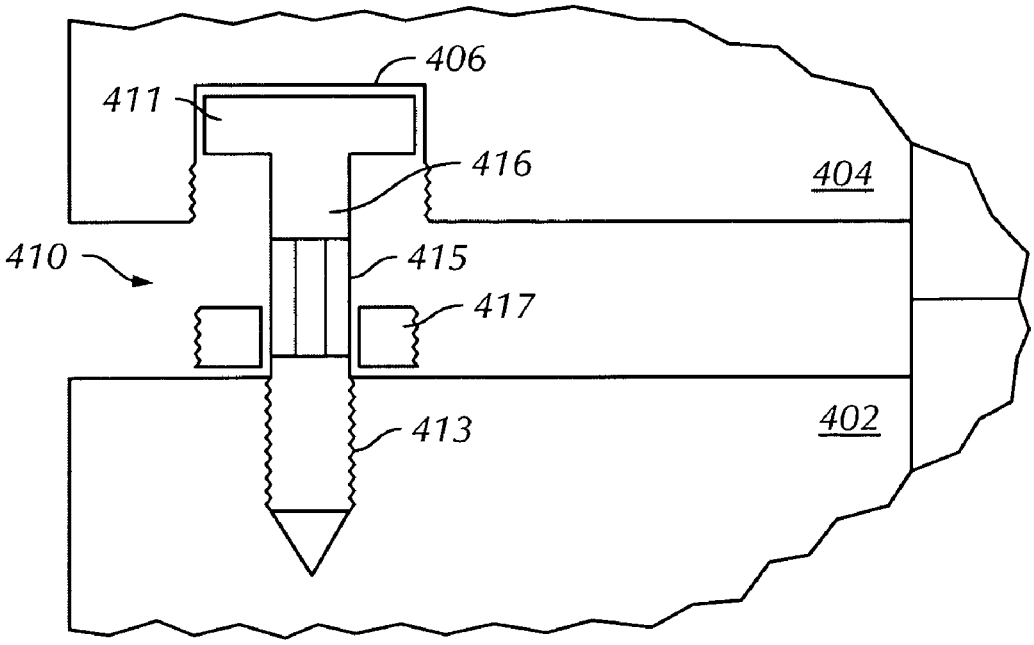
FIG. 4C shows a cross section of one embodiment of a fastener in accordance with the invention coupled to one blowout preventer with a second blowout preventer in a vertical arrangement with the first blowout preventer.

FIGS. 4B and 4C show how a BOP stack may be assembled using one embodiment of the invention. FIG. 4B shows a cross section of a lower BOP 402 with a fastener 410 coupled to the lower BOP 402. In some embodiments, such as the one shown in FIG. 4B, the fastener 410 is in threaded engagement with the lower BOP 402. The head 411 of the fastener 410 is positioned to be received in a recess (not shown) in an upper BOP (not shown). A retaining collar 417 is disposed around the elongated shaft 416 of the fastener 410, but the retaining collar is not yet otherwise coupled any part of a BOP.

FIG. 4C is similar to FIG. 4B, but FIG. 4C shows an upper BOP 404 that has been positioned above the lower BOP 402 in a BOP stack 400. The head 411 of the fastener 410 is received or positioned within a recess 406 in the upper BOP 404. In order to retain the head 411 of the fastener 410 in the recess 406 of the upper BOP 404, the retaining collar 417 may be coupled to the upper BOP 404, as shown in FIG. 4A. In some embodiments, the retaining collar 417 is coupled to the upper BOP 404 by a threaded engagement.

The method of installing the retaining collar 417 in not intended to limit the invention. For example, a retaining collar in accordance with the invention may include a handle to facilitate its installation. In the embodiment shown in FIGS. 4A–4C, the engagement of the retaining collar 417 does not increase the connection forces between the BOPs 402, 404; thus, a high torque is not required to install the retaining collar 417.

Once the upper BOP 404 is positioned above the lower BOP 402 and the retaining collar 417 is in place, the fastener 410 may be rotated to adjust the load between the upper BOP 404 and the lower BOP 402. As discussed above, with reference to FIG. 4A, the grip section 415 enables the fastener 410 to be rotated by a wrench or other tool (not shown).

Figure 4D:
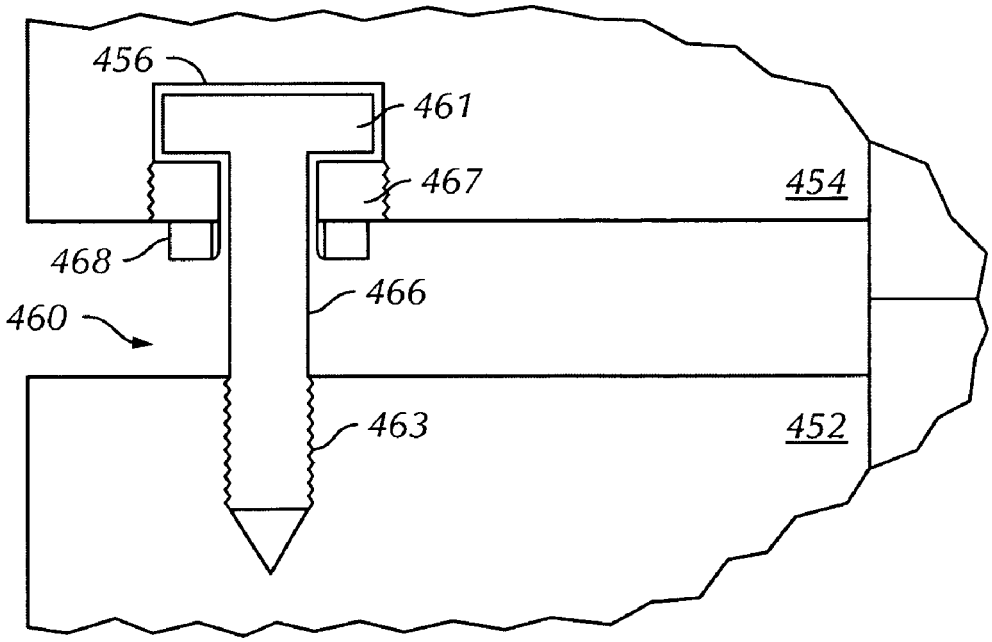
FIG. 4D shows a cross section of a fastener in accordance with one embodiment of the invention.

FIG. 4D shows another embodiment of a fastener 460 and a retaining collar 467 in accordance with the invention. The fastener 460 does not include a grip section. Instead, the retaining collar 467 includes a projection 468 that may be gripped by a wrench or other tool (not shown). In some embodiments, the projection 468 is a bolt section that has a hexagonal outside edge similar to that of a bolt head or a nut. The projection projects into the space between the BOPs, 452, 454 so that, similar to a grip section (415 in FIG. 4A) described above, it can be accessed in that space.

In this embodiment, the retaining collar 467 engages the head 461 of the fastener 460 to pull the fastener 460, which is in threaded connection with the lower BOP 452, further into the recess 456. In doing so, the connection forces may be increased. The load between the upper BOP 454 and the lower BOP 452 may be controlled by rotation of the retaining collar 467. The connection may be tightened or loosened, depending on the direction of rotation.

Figure 5A:
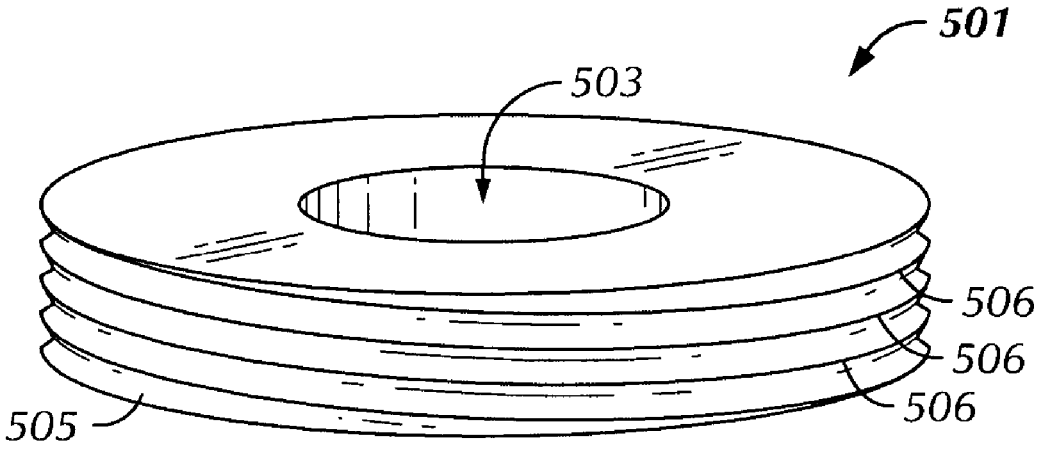
FIG. 5A shows a perspective view of a retaining collar in accordance with one embodiment of the invention.
Figure 5B:
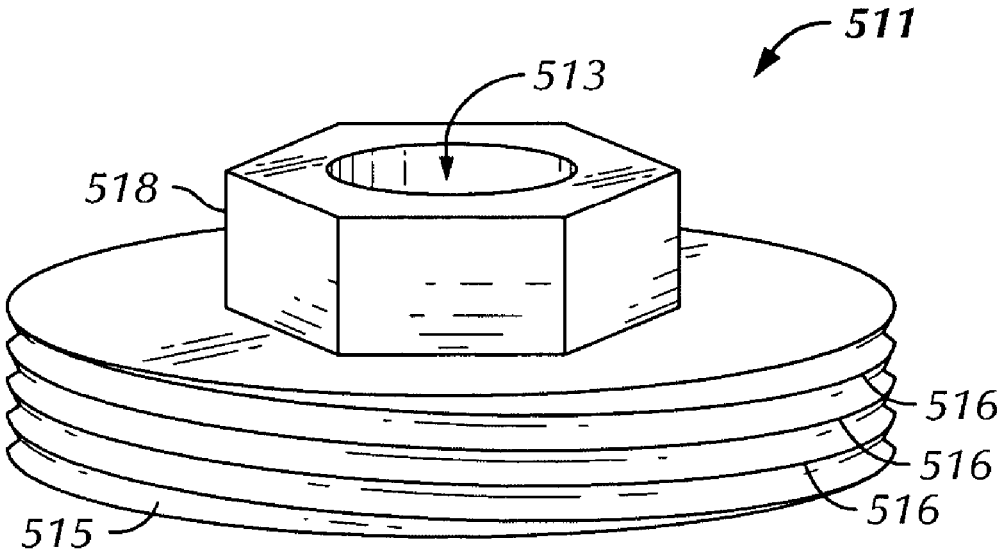
FIG. 5B shows a perspective view of a retaining collar in accordance with one embodiment the invention.

FIGS. 5A and 5B show two embodiments of retaining collars in accordance with the invention. These two embodiments are provided only as examples; the invention is not intended to be limited to these embodiments.

FIG. 5A shows one embodiment of a threaded retaining collar 501. The retaining collar 501 includes a center passage 503, through which a shaft (e.g., 416 in FIG. 4A) of a fastener may pass. The outside edge 505 of the retaining collar 501 includes threads 506 that are adapted to engage with corresponding threads (not shown) on a BOP (not shown) to retain the head of a fastener (not shown) in a recess of the BOP (not shown). This embodiment of a retaining collar is also shown in FIG. 4A.

FIG. 5B shows a perspective view of another embodiment of a retaining collar 511 in accordance with the invention, such as the one shown in FIG. 4D. The retaining collar 511 includes a central passage 513 and threads 516 formed on an outer edge 515 of the retaining collar 511. The retaining collar 511 also includes a projection 518 that projects from the retaining collar 511. In some embodiments, such as the one shown in FIG. 5B, the projection 518 is a bolt section that has a hexagonal outside edge that is shaped like a bolt head or nut. The bolt projection 518 is adapted to be gripped by a wrench or other tool so that the retaining collar 511 may be rotated while it is coupled to a BOP (not shown). This enables the connection between two BOPs (not shown) to be tightened or loosened, depending on the direction of rotation.

Figure 6A:
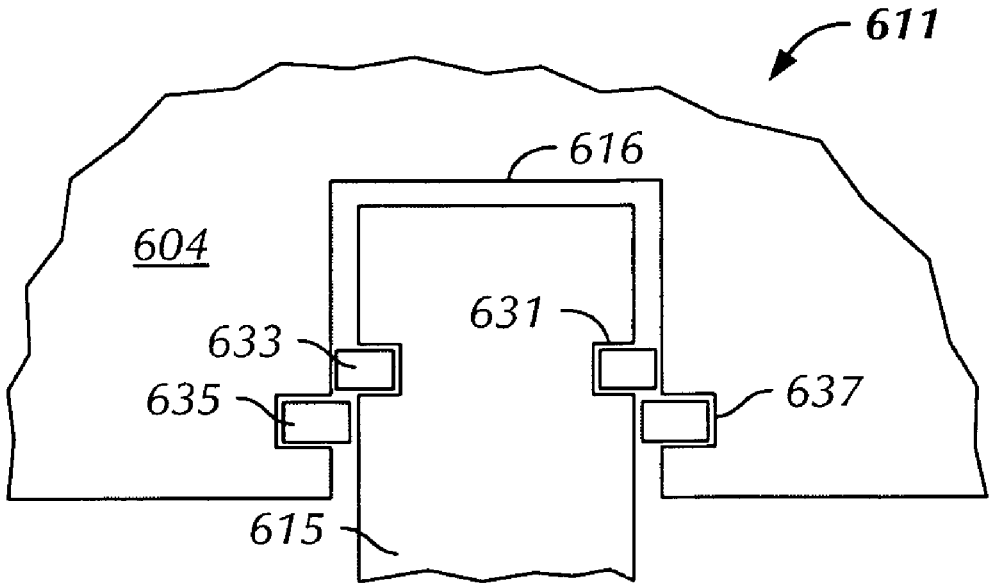
FIG. 6A shows a cross section of a head in accordance with one embodiment of the invention.

FIG. 6A is a cross section of the head 611 of a fastener in accordance with one embodiment of the invention. The head 611 includes a groove 631, and a head ring 633 positioned in the groove 631. The head ring 633 is a circular ring that surrounds the top of the elongated shaft 615. The head ring 633 creates the effect of having a head with a larger diameter than the nominal diameter of the elongated shaft 615.

A retaining ring 635 is installed in a groove 637 in the recess 616 in the BOP 604. The retaining ring 635 may be installed in the groove 637 of the recess 616 after the head 611 is positioned in the recess 616. The retaining ring 635 has an inner diameter that is smaller than the outer diameter of the head ring 633. Thus, when installed, the retaining ring 635 retains the head 611 in the recess 616 of the BOP 604.

Figure 6B:
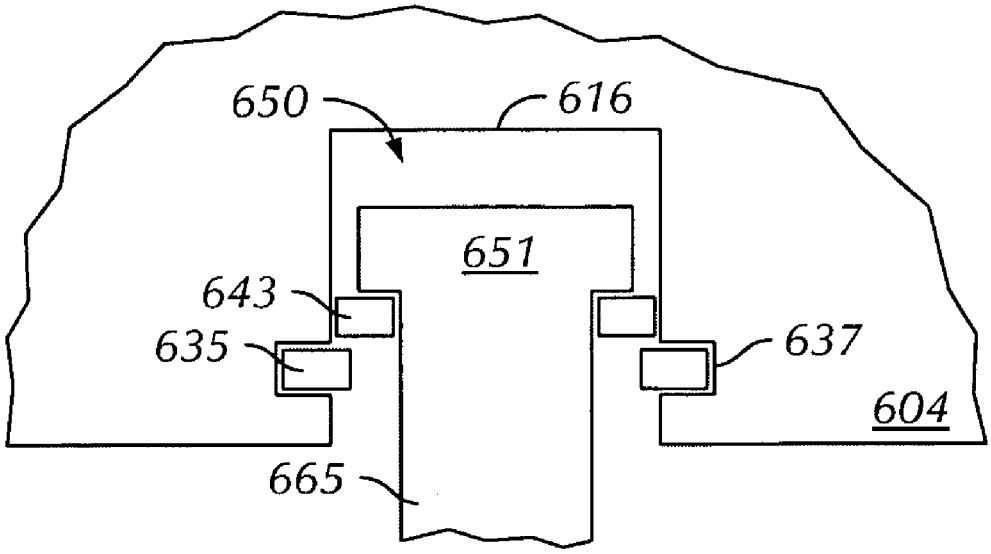
FIG. 6B shows a cross section of a head in accordance with one embodiment of the invention.

FIG. 6B shows a cross section of another embodiment of a fastener 650 in accordance with the invention. The fastener 650 includes a head 651 at the upper end of the elongated shaft 665. The head 651 is retained in a recess 616 of a BOP 604 by a retaining ring 635 that is positioned in a groove 637 in the recess 616. In some embodiments, such as the one shown in FIG. 6B, a support washer 643 is included between the retaining ring 635 and the head 651 that strengthens the connection.

Figure 7A:
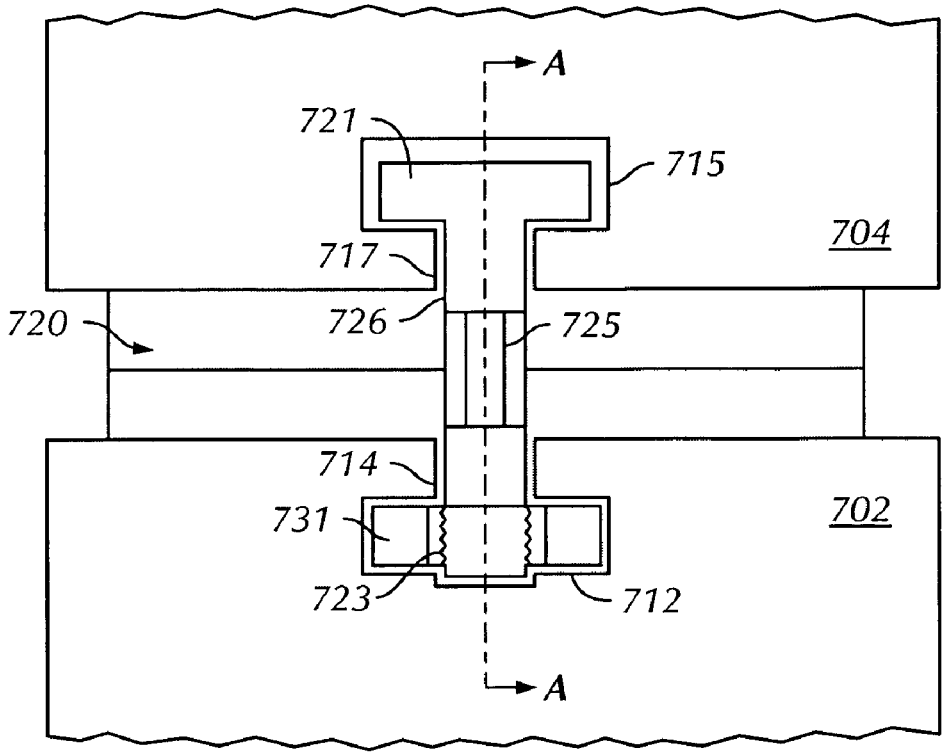
FIG. 7A shows a side view of a blowout preventer stack in accordance with one embodiment of the invention.

FIG. 7A shows a side view of lower BOP 702 and an upper BOP 704 that are coupled according to one embodiment of the invention. The lower BOP 702 includes a lateral passage 712 that leads from the outside of the lower BOP 702 to a recess (shown at 713 in FIG. 7B) that is internal to the lower BOP 702. The passage 712 includes a slot 714 that enables the movement of the elongated shaft 726 of the fastener 720.

The upper BOP also includes a lateral passage 715 that leads from the outside of the upper BOP 704 to a recess (shown at 716 in FIG. 7B) that is internal to the upper BOP 704. The passage 715 includes a slot 717 along the lower side of the upper BOP 704 that enables the movement of the elongated shaft 726 of the fastener 720.

The fastener 720 shown in FIG. 7A also includes a nut 731 that is in threaded engagement with a threaded section 723 of the fastener 720. The threaded section 723 is near the opposite end of the elongated shaft 726 from the head 721. As will be described later with reference to FIG. 7B, the nut enable the tightening and loosening of the engagement between the BOPs.

Figure 7B:
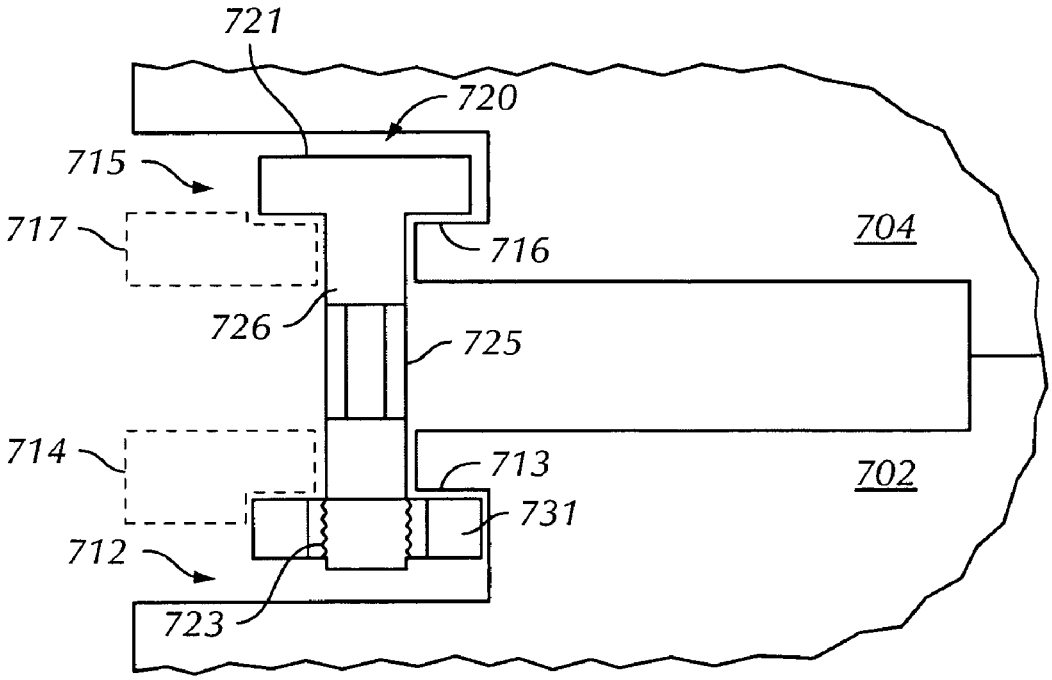
FIG. 7B shows a cross section of a blowout preventer stack and a fastener in accordance with one embodiment of the invention.

FIG. 7B shows a cross section taken along line A—A in FIG. 7A. The fastener 720 includes a head 721 at one end that can be positioned in the recess 716 in the upper BOP 704 by passing it through the lateral passage 715. Element 717 (which is also shown in FIG. 7A) of the upper BOP 704 is shown in dashed lines because it is not part of the cross section. It is still shown to illustrate how the head 721 is retained in the recess 716 in the upper BOP 704.

The nut 731 proximate the second end of the fastener 720 is retained in the recess 713 of the lower BOP 702. Element 714 (also shown in FIG. 7A) in the lower BOP 702 is shown in dashed lines to illustrate how the nut 731 is retained in the recess 713 of the lower BOP 702.

As can be seen in FIG. 7B, the fastener 720 may simultaneously be inserted into the recesses 713, 716 in both the lower BOP 702 and the upper BOP 704. Thus, with this embodiment of the invention, the BOPs 702, 704 may be positioned in a BOP stack, and then the fastener 720 may be installed to couple the BOPs 702, 704 to each other.

The recess 713 in the lower BOP 702 is shaped to match the shape of the nut 731 so that the nut 731 is prevented from rotating relative to the lower BOP 702 when the nut 731 in retained in the recess 713. In some embodiments, the nut 731 has a typical hexagonal bolt shape, although other shapes are also within the scope of the invention.

The fastener 720 shown in FIG. 7B also has a grip section 725 along the elongated shaft 726 of the fastener 720. The grip section 725 is positioned so that is can be accessed in the space between the BOPs 702, 704. The grip section 725 is shaped so that it can be gripped by a wrench or other tool (not shown) and rotated with respect to the BOPs 702, 704. In some embodiments, the grip section 725 has a typical hexagonal bolt shape, although other shapes are also within the scope of the invention.

When the fastener 720 is rotated with respect to the BOPs 702, 704, it is also rotated with respect to the nut 731, which is prevented from rotating with respect to the BOPs 702, 704. The threaded engagement between the nut 731 and the fastener 720 enables the engagement between the BOPs 702, 704 to be tightened and loosened by the rotation of the fastener 720, depending on the direction of rotation.

A fastener in accordance with the invention is not limited to having an integral head. It is noted that a nut is one type of an adjustable head. Thus, "head" is intended to mean a portion of the fastener that is larger than the nominal diameter of the shaft. Such a head may be integral, or it may be coupled to the shaft in any way known in the art, such as with a nut.

The embodiment shown in FIGS. 7A and 7B included slotted BOPs with recesses to retain the head or the nut of the fastener. Alternatively, a BOP may included a latch or a pin that holds the fastener in place. Also, the slot in one or both of the BOPs may be sloped so that tightening the connection will prevent the fastener from being removed from the slot of either BOP.

Figure 8A:
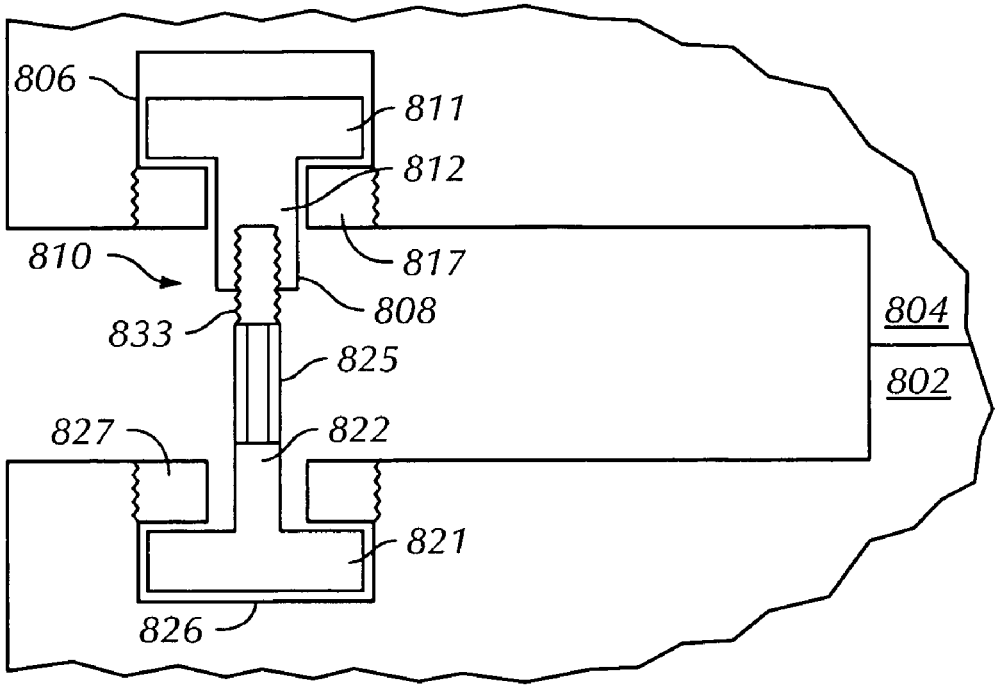
FIG. 8A shows a cross section of a blowout preventer stack and a fastener in accordance with one embodiment of the invention.

FIG. 8A shows a cross section of a fastener 810 in accordance with another embodiment of the invention. The fastener includes a two members 812, 822 that are each coupled to a BOP and that are coupled to each other. The lower member 822 includes a head 821 on one end that is retained in a recess 826 in the lower BOP 802 by a retaining collar 817. The other end of the first member 822 comprises a threaded member 833 that is coupled to a female section 808 of the second member 812 of the fastener 810.

The second fastener 812 includes a head 821 on one end that is retained in a recess 806 in the upper BOP 804 by a second retaining collar 827. The other end of the second member 822 is a female threaded section 808 that is coupled to the first member 812.

In the embodiment shown, the first member 812 and the second member 822 are coupled by a threaded connection. Thus, rotation of one of the members with respect to the other member will cause the connection to be tightened or loosened, depending on the direction of rotation. In some embodiments, the second member 822 includes a grip section 825 that enables the first member 822 to be griped by a wrench or other tool (not shown) so that it may be more easily rotated with respect to the second member 812.

The recess 806 in the upper BOP 804 is shown extending farther into the upper BOP 804 than the recess 826 in the lower BOP 802. This enables an upward or downward movement of the second member 822 to facilitate making the connection between the two members 812, 822 after the BOPs 802, 804 are positioned in a BOP stack. Additionally, the recess 806 in the upper BOP 804 may be shaped to prevent the rotation of the second member 812 relative to the upper BOP 804. For example, the head 811 of the second member 822 may be a hexagonally shaped head, like that of a bolt or nut. The recess 806 may also have a similar hexagonal shape that prevents the second member 822 from rotating.

Figure 8B:
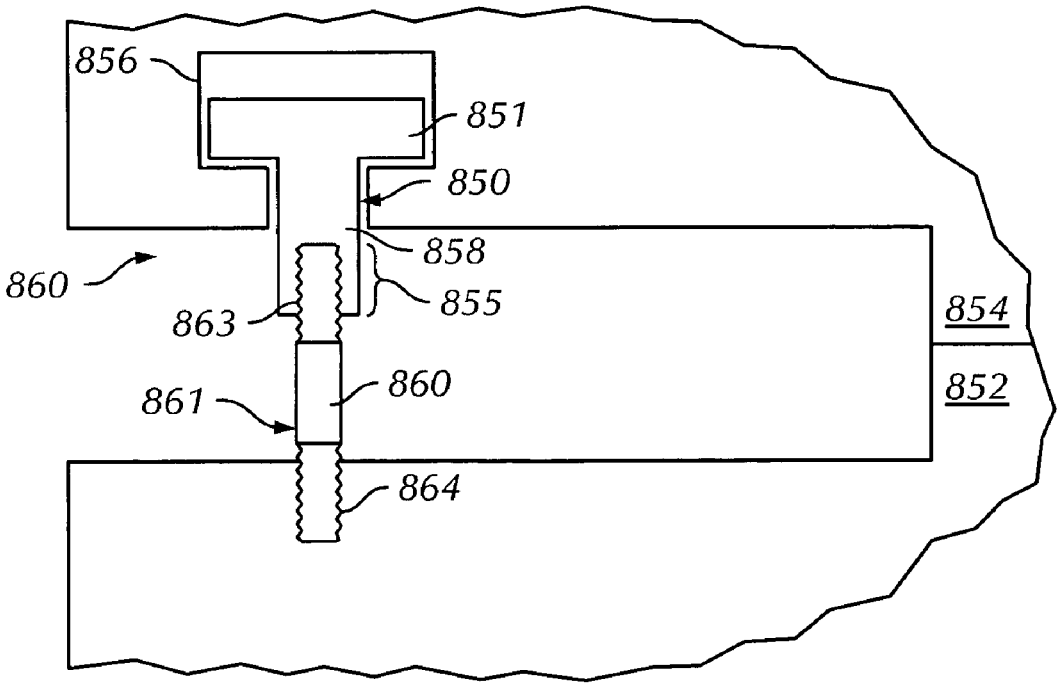
FIG. 8B shows a cross section of a blowout preventer stack and a fastener in accordance with one embodiment of the invention.

FIG. 8B shows another embodiment of a two-piece fastener 860 in accordance with the invention. The upper member 850 of the fastener includes a head 851 that is retained in a recess 856 in the upper BOP 854. The embodiment shown in FIG. 8B does not include a retaining collar (e.g., 817 in FIG. 8A) that retains the head 851 in the recess 856. Instead, the upper BOP 854 is designed to retain the head 851. That is, upper member 850 of the fastener 860 is permanently retained in the recess 856. In some other embodiments, the upper BOP 854 may include slots that enable the head 851 of the upper member 850 to be inserted from a outside of the upper BOP 854.

The lower member 861 of the fastener 860 includes a first threaded section 864 coupled to the lower BOP 852 and a second threaded section 863 coupled to the upper member 850 of the fastener 860. Rotation of the upper member 850 with respect to the lower member 861 will tighten or loosen the connection, depending on the direction of rotation.

In the embodiment shown in FIG. 8B, the recess 856 in the upper BOP 854 is shaped to enable the rotation of the head 851. The lower member 861 is prevented from rotation by its engagement with the lower BOP 852.

The upper member 850 includes a grip section 855 that enables the upper member 850 to be griped by a wrench or other tool (not shown) and rotated. In some embodiments, the grip section 855 is hexagonally shaped.

It is intended that the scope of the invention includes embodiments of a fastener with various of the features described herein, even though the particular features were not shown on the same embodiment. For example, an embodiment of a fastener in accordance with the invention may include a head on both ends of the fastener (i.e., as shown at 411 in FIG. 4A), where each head is retained in a recess of a BOP by a separate retaining collar. Also, a fastener may not include a head where each end of the fastener includes a threaded section that is in threaded engagement with a BOP. Those having skill in the art will be able to devise embodiments of a fastener that include any combination of the features described herein.

Additionally, many aspects of the present invention are described as including threads or being in threaded connection with another member. Nonetheless, the invention is not intended to be limited to threaded connections. For example, a retaining collar in accordance with the invention may be coupled to a BOP with a tongue and groove connection or with notches that fit into slots where the retaining collar can be rotated so that the notches are locked in place. While a threaded connection is used in some embodiments because of the ease of coupling the two members together and the strength of the connection, those having ordinary skill in the art will be able to devise other types of connections that do not depart from the scope of the invention.

Advantageously, the present invention enables two BOPs to be coupled together in a way that minimizes the vertical height of the BOP stack. A BOP fastener in accordance with the present invention provides more space near the well head for other well tools and equipment to be locates, and it provides more space in which rig personnel can maneuver. Additionally, a fastener in accordance with one or more embodiments of the invention requires less effort and work to couple two BOPs together.

The present invention may also be useful in connecting any two pressure containing bodies where space is an important factor. Further, due to the ease of connection, embodiments of the invention may be used where a flange or other means of connection would be difficult, dangerous, or burdensome. For example, embodiments of a fastener may be used to couple two sections of pipe that would otherwise be coupled by a typical flange. Also, a fastener in accordance with one or more embodiments of the invention may be used to connect an access door to a large pressure containing vessel. Advantageously, the access door with such a fastener would require less space and be easy to remove and install.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A fastener for coupling blowout preventers in a stack, comprising:

an elongated shaft having a first end and a second end; and a head disposed proximate the first end of the elongated shaft and adapted to be retained in a recess in a connecting face of a first blowout preventer, wherein the second end of the elongated shaft is adapted to be coupled to a second blowout preventer adjacent to the first blowout preventer.

2. The fastener of claim 1, wherein the head is integral to the fastener.

3. The fastener of claim 1, wherein the head comprises a head ring disposed in a groove proximate the first end of the elongated shaft.

4. The fastener of claim 1, wherein the head is coupled to the first end of the elongated shaft.

5. The fastener of claim 1, wherein the head comprises a nut in threaded engagement with the elongated shaft.

6. The fastener of claim 1, further comprising a threaded section proximate the second end of the elongated shaft, wherein the threaded section is adapted to be in threaded engagement with the second blowout preventer.

7. The fastener of claim 1, further comprising a second head disposed proximate the second end of the elongated shaft, wherein the second head is adapted to be coupled to the second blowout preventer by having the second head retained in a recess in the second blowout preventer.

8. The fastener of claim 1, further comprising a grip section disposed between the first end and the second end of the elongated shaft.

9. The fastener of claim 8, wherein the grip-section is hexagonally shaped.

10. A coupled blowout preventer stack, comprising:

a first blowout preventer having a plurality of recesses disposed in a connecting face of the first blowout preventer;

a second blowout preventer in a vertical arrangement with and adjacent to the first blowout preventer; and a plurality of fasteners each having an elongated shaft with a first end and a second end, the plurality of fasteners each comprising a head proximate the first end of the elongated shaft, wherein the heads are disposed in the plurality of recesses in the first blowout preventer and wherein the second ends of the plurality of fasteners are coupled to the second blowout preventer.

11. The coupled blowout preventer stack of claim 10, wherein the plurality of fasteners each further comprise a threaded section proximate the second end of the elongated shaft that is in threaded engagement with the second blowout preventer.

12. The coupled blowout preventer stack of claim 10, wherein the plurality of fasteners each further comprise a grip section disposed between the first end and the second end of the elongated shaft.

13. The coupled blowout preventer stack of claim 12, wherein the grip sections are hexagonally shaped.

14. The coupled blowout preventer stack of claim 10, wherein the heads of the plurality of fasteners are retained in recesses by retaining collars.

15. The coupled blowout preventer stack of claim 14, wherein the retaining collars are in threaded engagement with the first blowout preventer.

16. The coupled blowout preventer stack of claim 14, wherein the retaining collars each comprise a retaining ring disposed in a groove in the one of the plurality of recesses in the first blowout preventer.

17. The coupled blowout preventer stack of claim 10, wherein the first blowout preventer comprises a plurality slots extending from the recesses in the first blowout preventer to the outside of the first blowout preventer.

18. The coupled blowout preventer stack of claim 17, wherein the second blowout preventer comprises a plurality slots extending from recesses in the second blowout preventer to the outside of the second blowout preventer.

19. The coupled blowout preventer stack of claim 10, wherein the heads of the plurality of fasteners are integral with the elongated shafts of the plurality of fasteners.

20. A method for coupling two blowout preventers in a blowout preventer stack, comprising:

coupling a first end of each of a plurality fasteners to a first blowout preventer;

positioning a second blowout preventer in a vertical arrangement with and adjacent to the first blowout preventer so that a head on a second end of the each of the plurality of fasteners is received in one of a plurality of recesses in the second blowout preventer;

coupling a plurality of retaining collars to the second blowout preventer so that the heads of the plurality of fasteners are retained in the plurality of recesses in the second blowout preventer; and tightening the connection.

21. The method of claim 19, wherein tightening the connection comprises rotating the plurality of fasteners.

22. The method of claim 19, wherein tightening the connection comprises rotating the plurality of retaining collars.

23. A fastener for coupling blowout preventers in a stack, comprising:

a first member having a first head adapted to be retained in a recess in a first blowout preventer; and a second member adapted to be coupled to a second blowout preventer adjacent to the first blowout preventer;

wherein the first member and the second member are configured to be coupled to each other.

24. The fastener of claim 23, wherein the second member comprises a second head adapted to be retained in a recess in the second blowout preventer.

25. The fastener of claim 23, wherein the second member is adapted to be in threaded engagement with the second blowout preventer.

26. The fastener of claim 23, wherein the first member further comprises a female threaded section, and the second member further comprises a male threaded section.

27. The fastener of claim 23, further comprising a grip section disposed on at least one selected from the group consisting of the first member and the second member.

28. The fastener of claim 27, wherein the grip section is hexagonally shaped.

29. The fastener of claim 23, wherein the second member comprises a second head adapted to be retained in a recess in the second blowout preventer, wherein the first member further comprises a female threaded section and the second member further comprises a male threaded section, and further comprising a grip section disposed on the first member.

30. The fastener of claim 23, wherein the second member is adapted to be in threaded engagement with the second blowout preventer, wherein the first member further comprises a female threaded section and the second member further comprises a male threaded section, and further comprising a grip section disposed on the first member.

* * * * *

UNITED STATES PATENT AND TRADEMARK OFFICE

CERTIFICATE OF CORRECTION

PATENT NO. : 7,011,159 B2
DATED : March 14, 2006
INVENTOR(S) : William R. Holland It is certified that error appears in the above-identified patent and that said Letters Patent is hereby corrected as shown below:

Title page

Item [56], References Cited, FOREIGN PATENT DOCUMENTS,

| | | | | | |
|---|---|---|---|---|---|
| "DE | 0 824 173 A1 | 2/1998" should read -- | EP | 0 824 173 A1 | 2/1998 --. |
| "EP | 0 523 393 A1 | 1/1993" should read -- | EP | 0 523 393 B1 | 1/1993 --. |

Signed and Sealed this

Thirteenth Day of June, 2006

JON W. DUDAS
*Director of the United States Patent and Trademark Office*